United States Patent [19]

Ambrose

[11] 4,296,168

[45] Oct. 20, 1981

[54] PADDING SHEET FORMED OF A MIXTURE OF FIBERS BONDED AT THEIR INTERSECTIONS

[76] Inventor: Jere B. Ambrose, 5645 Lakeshore, Holland, Mich. 48423

[21] Appl. No.: 122,134

[22] Filed: Feb. 19, 1980

[51] Int. Cl.[3] ..... D04H 1/58

[52] U.S. Cl. ..... 428/288; 428/296

[58] Field of Search ..... 428/195, 198, 280, 288, 428/296, 297, 298, 299, 302

[56] References Cited

U.S. PATENT DOCUMENTS

| | | | |
|---|---|---|---|
| 3,620,892 | 11/1971 | Wincklhofer et al. | 428/296 |
| 3,639,195 | 2/1972 | Sanders | 428/296 |
| 3,801,428 | 4/1974 | Striegler et al. | 428/296 |
| 4,128,679 | 12/1978 | Pohland | 428/288 |

*Primary Examiner*—James J. Bell

*Attorney, Agent, or Firm*—Cullen, Sloman, Cantor, Grauer, Scott & Rutherford

[57] ABSTRACT

The mixture of fibers forming a relatively dense, thick, non-woven matted padding sheet are bonded together by means of incorporating a minor proportion of loose, relatively low heat softening point, polypropylene fibers in the mixture and momentarily heating the matted sheet sufficiently to momentarily soften the polypropylene fibers so that they adhere to the other fibers at their points of intersection therewith. Thus, the overall mixture of fibers are bonded together by the randomly extending polypropylene fibers.

1 Claim, 3 Drawing Figures

PADDING SHEET FORMED OF A MIXTURE OF FIBERS BONDED AT THEIR INTERSECTIONS

BACKGROUND OF INVENTION

The invention herein relates to relatively thick, non-woven fiber padding sheets which are typically used as underlay padding in upholstered furniture or within the upholstered seats of automotive vehicles, or as soundproofing material within the bodies of automotive vehicles. In the past, this type of padding material has been made of loose fibers obtained by shredding cotton and synthetic fiber cloths and thereafter matting or felting the fibers together. The fibers were bonded together, that is, at their points of intersection, by means of resinous binding materials.

The resinous binding materials which were used to bond together the fibers of the non-woven padding sheets, were typically phenolic based or latex based materials, usually applied in a dry powder form, although in some cases, sprayed wet and then dried.

The conventionally used process for forming such fibers involves first breaking open bales of scrap cloth and then shredding the cloth within shredding machinery. The fibers are then mixed together in a blending machine to obtain as uniform a blend as possible. Thereafter, the resinous material is blended in, typically in the range of roughly 20% by weight as compared to the cloth fibers.

The fibers and resinous bonding material are deposited in a loose sheet form in a non-woven fiberous material matting machine which includes a conveyor for moving the sheet through a heater and equipment for compacting the sheet to sepcified thickness. In the past, either heated rollers or heated guide plates were used to activate the bonding resin and to reduce the thickness of the sheet to either the desired dimension or close to the desired dimension. The setting of the resin within the heater or thereafter by air blast cooling, along with any necessary compacting to final thickness, resulted in the padding sheet being completed.

The completed padding sheet is ordinarily rolled into a thick roll for later use in sheet form or alternatively is immediately die cut to required sizes and shapes, as for example, to fit within the door or under the hood of an automobile for soundproofing, or within a particular size and shape upholstered piece.

By way of an example, a typical non-woven padding sheet may run roughly 27 to 180 grams per square foot and may vary in thickness from one quarter inch through one inch, approximately. The weights and the thicknesses vary depending upon the uses to which the padding is put, that is, as a soundproofing material, an underlay material or the like.

Typical non-woven padding materials of the type involved in the invention herein, are made of blends of roughly 80% by weight of cotton or synthetic fiberous materials, and 20% by weight of the resin which acts as the binder. As mentioned, the fibers normally come from scrap materials, such as rags or scrap cloth.

In the conventional system for forming such padding, the resultant padding material is relatively easily torn or transversely separated or delaminated, it has relatively low strength and therefore must be handled carefully because of its fragility. Moreover, the presently used conventional resins are petroleum based materials which have been increasing in price in recent times. Moreover, such materials are relatively difficult to handle when in dry powder form. Particularly, in the case of conventional phenolic powder and the like materials, there is a dust problem resulting from the dry powder being lifted into the surrounding atmosphere and therefore, the handling of floating dust around the matting equipment is troublesome.

Thus, the invention herein is concerned with an improved padding and method of making same, which follows the prior art or conventional procedure and utilizes conventional manufacturing equipment, except for an improved bonding system which is described below in this specification.

SUMMARY OF INVENTION

The invention herein contemplates incorporating a minor proportion of randomly arranged fibers of polypropylene or the like relatively low temperature softening point thermo-plastic material in the fiberous blend which is thereafter felted or matted into the non-woven padding sheet. Heat is applied to the loosely assembled mixture and the mixture is compressed to approximately finished thickness and then cooled. Thus, the polypropylene fibers bond the fiber blend together at random locations, that is, at a number of points of intersections or overlapping contacts of each polypropylene fiber and the other fibers. Consequently, conventional powdered bonding resins are eliminated and bonding is provided by numerous, elongated strands rather than by discrete particles.

In manufacturing the improved padding, the process includes first shredding the scrap cloth, as is conventional, and also shredding polypropylene cloth or utilizing pre-shredded polypropylene cloth which is in loose fiber condition. The fibers are blended together, then spread out into loose sheet form. Next, the sheet is heated and compressed to approximate finished thickness and thereafter cooled. Thus, momentarily the polypropylene fibers are softened sufficiently to cause them to adhere to intersecting fibers.

The heat softened material may be rapidly cooled by the use of conventional air blasts so that the complete, relatively dense or compact padding, may immediately be rolled into sheet roll form or alternatively die cut into pieces of predetermined shape and size.

Because the polypropylene fibers are randomly oriented relative to the padding, that is, they curve and curl in three dimensions, there is a structural rigidification which takes place within the padding. That is, the padding is substantially stronger and much better able to resist tearing or transverse delamination as compared to conventional padding.

It is contemplated to utilize roughly 20% by weight, plus or minus a few percentage, polypropylene fibers relative to the weight of the other fibers. For most uses, that is sufficient to form the complete padding without any additional use of resins. However, for some uses it is desirable to use a low percentage of resin in addition to the multi-directionally oriented strands of polypropylene. Where such additional resins are used, they may be in the low range of roughly 2% as compared to normal usage of about 20%. Thus, there is a substantial reduction in the use of expensive resins and simultaneously a substantial increase in the strength and tear resistence of the resulting product.

Since conventionally available polypropylene fibers soften at a relatively low temperature and are easy to handle, it is an ideal material to use for this purpose.

However, it is contemplated that similar materials may be utilized where they have corresponding characteristics for performing the process of this invention and producing the padding described herein.

Various objects and advantages of this invention will be further described in the following specifications, of which the attached drawings form a part.

DETAILED DESCRIPTION

Figure 3:
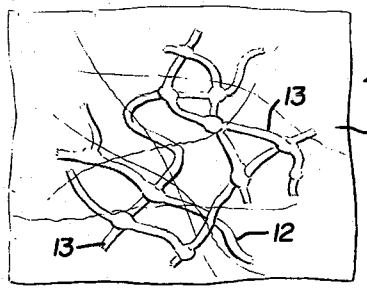
FIG. 3 is an enlarged, schematic view showing the arrangement of the fibers which make up the padding.

The padding sheet, generally designated at 10, is schematically illustrated in FIG. 3. The sheet may be formed of fibers of different kinds of materials, as for example cotton fibers 11, rayon or other syntehtic fibers 12 and a minor proportion of polypropylene fibers 13. These fibers extend in randomly oriented directions in three dimensions, frequently curling and twisting. Where the fibers overlap the polypropylene fibers they are bonded together. That is, the polypropylene fibers act like elongated strands or hair-like strips of an adhesive material, but of considerable strength and structural integrity, which bridge and interconnect adjacent fibers.

Figure 1:
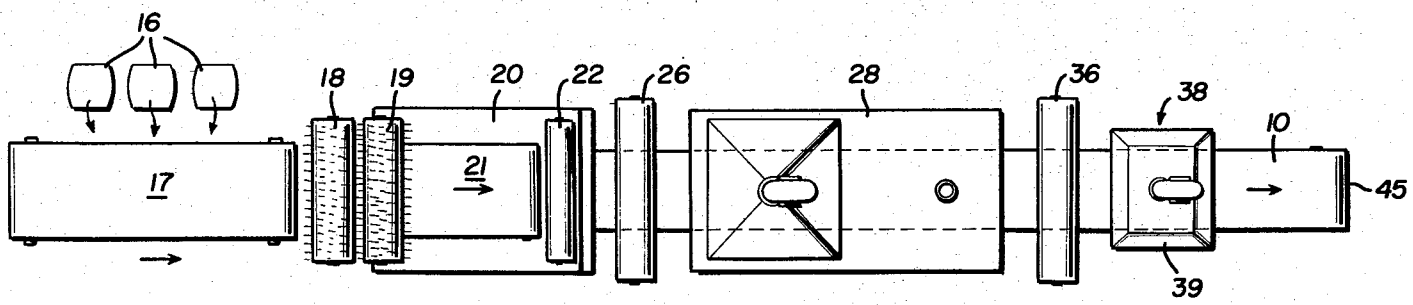
FIG. 1 is a schematic, top or plan view of the equipment utilized in forming the padding of this invention.
Figure 2:
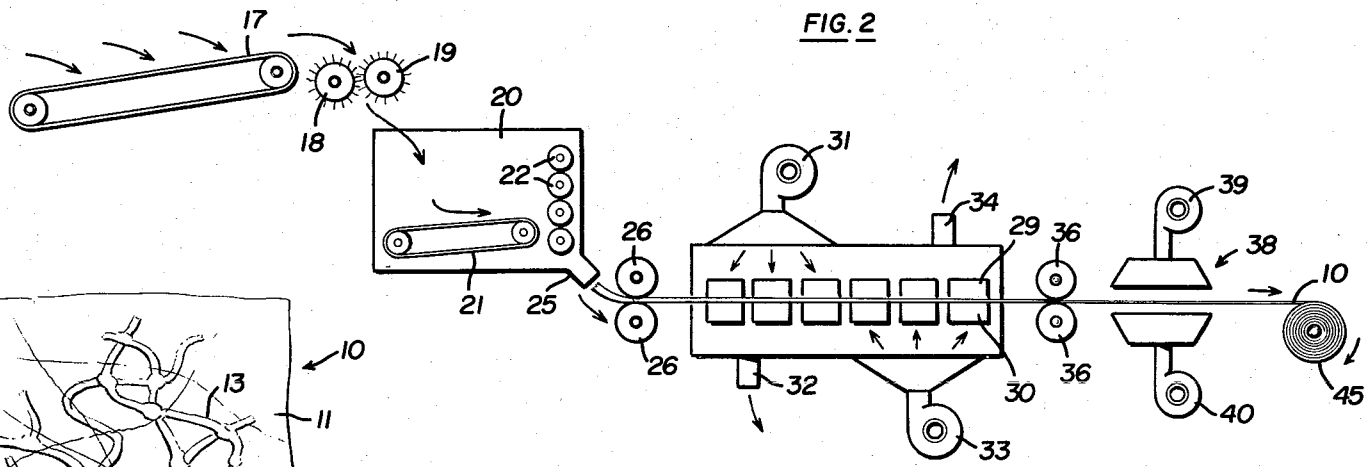
FIG. 2 is a schematic, elevational view of the equipment shown in FIG. 1.

The equipment for manufacturing the padding sheets 10 is conventional. That is, it is conventionally used for manufacturing similar types of non-woven fiber sheets. Thus, FIGS. 1 and 2 schematically illustrate the equipment. The individual units or components of the equipment may be varied considerably within the range of commercially available components.

Referring to FIG. 1, the starting point for the manufacture of the non-woven padding sheets is the bales 16 made up of rags or scrap cloth materials of various kinds. The bales are broken open and the scrap material is placed upon the conveyor 17 as indicated by the arrows from the bales to the conveyor.

Next, the scrap cloth material is passed through shredding or mixing rollers 18 and 19 which are schematically illustrated. These rollers shred the cloth into fibers which are passed into a blender 20. The blender, which is a commercially available unit, generally includes a belt conveyor 21 upon which the shredded fibers are carried and a number of blending rollers 22 through which the fibers repeatedly pass in order to substantially uniformly blend them together.

The blended fibers pass through an exit hopper 25 and are positioned either upon a conveyor or through suitable preliminary sizing rollers 26 which initially form the loose sheet out of the fibers coming from the blender. That loose sheet then passes through a furnace or heater 28 having opposing heated upper plates 29 and lower plates 30. These plates heat the sheets and also, in at least certain types of equipment available, tend to compact the sheets into near finished thickness.

In certain types of heaters, hot air is circulated through the forming sheets. This is schematically illustrated by the upper air blower 31 which blows air between the plates near the entrance end of the heater, with the heated air then passing through the sheet and out through an air outlet 32. A similar blower 33 located near the exit end of the furnace blows air upwardly through the sheet and out through an upper exhaust outlet 34.

The sheet passes through the heater and out through conveyor and final sizing rollers 36 and between air cooler 38 upper blower 39 and lower blower 40 which cools the sheet by means of ambient air. The substantially cooled sheet may then be rolled into a finished roll 45 which may be stored and later processed. Alternatively, the sheet may be directly passed through cutting dies where it may be cut into predetermined sizes and shapes. For example the sheet may be die cut into parts of a size and shape to fit within a portion of an automobile body where it might act as a noise reduction padding or to fit within an upholstered piece, etc.

The process described above is essentially conventional. The improvements which relate to the invention herein, involves the utilization of the polypropylene strands which may be obtained by starting with a bale of scrap polypropylene woven cloth which is shredded to provide the hair-like strands. That is, the bale of polypropylene cloth would be handled in the same way as that described in connection with bales 16 and would form one of the bales 16.

Although the ratio of polypropylene strands to the remaining fibers can vary depending upon the strength requirements and the economics of available scrap materials, a good operating ratio is in the range of roughly 20 to 22 percent polypropylene strands, by weight, compared to strands of a mixture of cotton and other synthetic fibers. Conventional non-woven padding of the type involved here utilizes about 20 percent by weight of resin binder material. Thus, the polypropylene strands, in essence, replace the powdered binder material.

For some purposes, the addition of a small amount of binder may be desirable, such as in the range of about 2 percent by weight of conventional binder to the remaining weight of the fiberous material. However, for normal usages, the binder may be eliminated entirely.

The polypropylene material tends to soften at a relatively low temperature. For example, ordinary isotactic polypropylene will soften in the range of about 260°–305° F. and will melt at roughly about 340° F.

By running the loose sheet through the furnace, which may be on the order of about 50 or 60 feet long, at about 450°–525° F., sufficient heat is provided to soften the polypropylene strands in the sheet as it passes through the furnace. Thus, each of the polypropylene strands tends to adhere, in numerous places, to the cross over or intersection points with the other fibers. Meanwhile, the spacing of the plates may be arranged to gradually compact or reduce the thickness of the forming sheet passing through the furnace. When the sheet exits from the furnace, passes through the final sizing rolls and is cooled by the air blast, the bonding between the polypropylene strands and the other strands is set. This fixes the final thickness of the material. Conventionally usable material is in the thickness range of about $\frac{1}{8}$ inch to 1 inch, although the thickness may vary considerably, depending up uses.

Commercially usable non-woven padding material of the type described here generally runs in the range of 27 to 180 grams per square foot, which is the standard measuring system. Again, the weight and thicknesses with respect to different weights may vary, but in general what is involved is a relatively dense material which looks like heavy felt.

Because each of the polypropylene strands is bonded or joined to a number of other strands and because the polypropylene strands each extend in three dimensional directions, there is a marked increase in the strength of the finished sheets. That is, the finished sheet is much more difficult to tear and has a much greater resistance to transverse separation or delamination than conventional padding.

Having fully described an operative embodiment of this invention, I now claim:

1. In a relatively thick, dense, non-woven fiber matted padding formed of a mixture of hair-like fibers bonded together at their intersections, the improvement comprising:

said fibers including cotton or other synthetic fibers and a minor proportion of a relatively low heat softening point thermo-plastic material which is shredded to provide fine fibers of thermo-plastic material, said fine fibers of thermo-plastic material randomly mixed within the over all mixture, said thermo-plastic fibers being formed of polypropylene, said polypropylene fibers being about 20–22 percent by weight compared with the total of the other fibers in the mixture;

said thermo-plastic material fibers each being randomly oriented within the mixture and being bonded by moving the mixture through an elongated furnace at about 450°–525° F. for heat softening the thermo-plastic material fibers to the other fibers upon which they form overlapping contact, to thereby randomly bond the fiberous mixture together without a separate bonding additive, wherein the padding is substantially free of conventional bonding resins.

* * * * *